US008420969B2

(12) United States Patent
Marushima et al.

(10) Patent No.: US 8,420,969 B2
(45) **Date of Patent: *Apr. 16, 2013**

(54) SWITCHGEAR AND SWITCHGEAR OPERATING MECHANISM

(75) Inventors: Satoshi Marushima, Kanagawa (JP); Yoshiaki Ohda, Kanagawa (JP); Yoshikata Kobayashi, Tokyo (JP); Masaharu Shimizu, Kanagawa (JP); Hirokazu Takagi, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 319 days.

This patent is subject to a terminal disclaimer.

(21) Appl. No.: 12/881,880

(22) Filed: Sep. 14, 2010

(65) Prior Publication Data

US 2011/0000768 A1 Jan. 6, 2011

Related U.S. Application Data

(63) Continuation-in-part of application No. PCT/JP2009/001315, filed on Mar. 25, 2009.

(30) Foreign Application Priority Data

Mar. 28, 2008 (JP) ..... 2008-086511

(51) Int. Cl.
*H01H 5/00* (2006.01)

(52) U.S. Cl.
USPC ..... 200/400; 200/318; 218/154

(58) Field of Classification Search ..... 218/7, 14, 218/152–154; 200/400, 401, 500, 501, 318, 200/321–327, 335–337; 335/8–10, 21, 22, 335/26–29, 167–171, 189–192
See application file for complete search history.

(56) References Cited

U.S. PATENT DOCUMENTS

2008/0078666 A1* 4/2008 Ohda et al. ..... 200/400
2010/0126967 A1 5/2010 Ohda et al.
2011/0073446 A1 3/2011 Marushima et al.

FOREIGN PATENT DOCUMENTS

JP 53-59651 5/1978
JP 59-103327 7/1984

(Continued)

*Primary Examiner* — Amy Cohen Johnson
*Assistant Examiner* — Marina Fishman
(74) *Attorney, Agent, or Firm* — Oblon, Spivak, McClelland, Maier & Neustadt, L.L.P.

(57) ABSTRACT

An embodiment of a switchgear has: a closing shaft; a main lever fixed to the closing shaft and associated with a movable contact; a cutoff spring; a sub-shaft; a sub-lever and a latch lever which are connected to the sub-shaft; a roller pin mounted to the leading end of the latch lever; a latch; a latch returning spring for urging the latch; a latch pin fixed to the latch; and a ring mounted to the latch pin so as to be movable in the radial direction of the latch pin. In the closed state, the roller pin presses the leading end of the latch. In power cutoff operation, latch is pulled so as to permit rotation of the latch, engagement between the roller pin and the leading end of the latch is disengaged, and the sub-shaft is rotated by urging by the cutoff spring.

19 Claims, 10 Drawing Sheets

FOREIGN PATENT DOCUMENTS

| | | |
|---|---|---|
| JP | 03-040323 | 2/1991 |
| JP | 04-341713 | 11/1992 |
| JP | 08-096670 | 4/1996 |
| JP | 11-213824 | 8/1999 |
| JP | 2000-040445 | 2/2000 |
| JP | P3497866 | 11/2003 |
| JP | 2004-022375 | 1/2004 |
| JP | 2007-294363 | 11/2007 |
| WO | WO 9910906 | 3/1999 |
| WO | WO 2009119080 | 10/2009 |

* cited by examiner

SWITCHGEAR AND SWITCHGEAR OPERATING MECHANISM

CROSS REFERENCES TO RELATED APPLICATIONS

This application is a continuation-in-part (CIP) application based upon the International Application PCT/JP2009/001315, the International Filing Date of which is Mar. 25, 2009, the entire content of which is incorporated herein by reference, and is based upon and claims the benefits of priority from the prior Japanese Patent Applications No. 2008-086511, filed in the Japanese Patent Office on Mar. 28, 2008, the entire content of which is incorporated herein by reference.

FIELD

Embodiments described herein relate to a switchgear for opening/closing an electrical circuit and its operating mechanism and, more particularly, to a switchgear and its operating mechanism suitably configured for cutting off high-voltage current in short time periods.

BACKGROUND

In general, there are available, as an operating mechanism of a switchgear, one using a hydraulic operating force for large power and one using a spring operating force for middle/small output power. The former is referred to as "hydraulic operating mechanism" and the latter as "spring operating mechanism". In recent years, the advancement of size reduction of an arc-extinguishing chamber of a gas-insulated circuit breaker which is a type of a switchgear allows fault current to be cut off with a smaller operating force, so that application of the spring operating mechanism becomes popular. However, a gas-insulated circuit breaker of extra high-voltage class requires high-speed operating capability called "2-cycle operation" that is capability of achieving cutoff within a time length corresponding to two-cycle time periods of alternating current. A conventional spring operating mechanism typically has operating capability equivalent to about 3-cycle operation, and it is not easy to realize the two-cycle cutoff capability due to poor responsiveness of a retention mechanism or retention control mechanism of a spring force.

A first type of conventional example of an operating mechanism of such a switchgear is disclosed in Japanese Patent Application Laid-Open Publication No. 11-213824 (FIGS. 1 and 7), Japanese Patent Application Laid-Open Publication No. 2000-40445 (FIGS. 1 and 3) and Japanese Patent Application Laid-Open Publication No. 2007-294363 (FIGS. 7 and 8), the entire contents of which are incorporated herein by reference. In operation mechanisms disclosed in these documents, a force of a cutoff spring is retained by a retention mechanism constituted by a latch, O-prop (opening-hook lever), and a catch through an output lever. In this configuration, when a trip current is applied to a solenoid serving as a retention control mechanism, a plunger of the solenoid activates the catch to allow the engagement between the catch and prop to be released, which releases the engagement between the output lever and the latch to rotate the output lever to release the cutoff spring force, thereby achieving cutoff operation.

A second type of conventional example of the switchgear operating mechanism is disclosed in Japanese Patent No. 3497866 (FIGS. 1 to 4), the entire content of which is incorporated herein by reference. In a spring operating mechanism disclosed in this document, a pull-out lever and a retention lever are provided for retaining a cutoff spring force. In this configuration, the retention lever is activated not by the cutoff spring force but by a force of an acceleration spring at the cutoff operation time so as to release the cutoff spring force.

In the first type of conventional example of the switchgear operating mechanism, operation for releasing the cutoff spring force (cutoff operation) is constituted by the following three steps: operation of the catch driven by excitation of the solenoid, operation of the O-prop, and operation of electrical contacts including the cutoff spring. The operational relationship between the above components is illustrated in FIG. 14. The horizontal axis denotes time, and vertical axis denotes a stroke of each components. In FIG. 14, the lowermost curve represents the waveform of a trip current and, above this, the stroke of the catch is depicted. Above this, the strokes of the O-prop and the cutoff spring are depicted. The uppermost curve represents an energizing signal of the contact in an arc-extinguishing chamber of a gas-insulated circuit breaker.

Time length from the start of application of the trip current until the operation of the O-prop is started along with the operation of the catch is assumed to be T1. Time length from the start of operation of the O-prop to the start of operation of the cutoff spring is assumed to be T2. Time length from the start of operation of the cutoff spring until the cutoff spring reaches its contact opening point is assumed to be T3. Assuming that contact opening time period is T0, $$T0=T1+T2+T3 \tag{1}$$

is satisfied.

In order to realize 2-cycle operation, it is necessary to reduce contact opening time period T0 to a given value. Thus, in a typical spring operating mechanism, operations of the components from the catch to the cutoff spring, which occur after the trip current application, are not started simultaneously. That is, the catch operates to some degree to release the engagement between itself and the O-prop to thereby allow operation of the O-prop to be started, and the cutoff spring starts operating after the O-prop operates to some degree. Thus, a mechanism that-retains a cutoff spring force operates in a stepwise manner, so that it is necessary to reduce respective time lengths T1, T2, and T3 in order to reduce T0.

However, since the cutoff spring force is determined by the weight of a movable portion of the arc-extinguishing chamber, opening speed, and drive energy, there is a limit to a reduction of T3. With regard to T2, weight reduction of the O-prop and increase in a force (retention force) of retaining the cutoff spring force allow high-speed operation of the O-prop. However, when the retention force is increased, the size of the O-prop needs to be increased for strength, which limits the weight reduction of the O-prop. It follows that there occurs a limit in the improvement in operation speed relying on the increase in the retention force. Further, when the retention force is increased, a large force is applied to the engagement portion between the O-prop and the catch, so that there occurs a need to increase the size of the catch for strength and to provide a solenoid having a large electromagnetic power for activating the catch.

At present, an excitation method using a large-sized condenser is adopted for obtaining a large power of the solenoid. However, the upper limit value for a current value flowing to the solenoid is specified in the standard, so that there is a limit in the improvement in the output power of the solenoid. As described above, it is difficult to reduce the contact opening time period in the conventional spring operating mechanism.

Also in the second type of conventional example, operation for releasing the cutoff spring force is constituted by the following three steps: operation of a pull-off hook driven by an electromagnet; simultaneous operation of a reset lever, acceleration spring, and a retention lever; and simultaneous operation of a pull-off lever and a cutoff spring. In this example, the direction of a retention force (pressuring force) of the cutoff spring is made substantially coincident with the rotation center of the retention lever, thereby reducing a force required for the operation of the retention lever.

Further, the speed of movement of the retention lever, which is included in the above second step, is made higher by the accelerating spring to thereby reduce the operation time period. However, it is physically difficult to reduce the operation time period of the second step to zero and, therefore, it is difficult to significantly reduce the entire contact opening time period, also in terms of the problems described in the first example.

Further, the direction of a pressuring force to a portion at which the pull-off lever and the retention lever are engaged with each other is made substantially coincident with the rotation center of the retention lever, so that when an external vibration is applied to the retention lever to force the same to vibrate, the pull-off lever is rotated in the cutoff operation direction, and the cutoff operating mechanism may start operating without a cutoff command. Further, the direction of the pressuring force may fluctuate with respect to the rotation center of the retention lever due to deformation of the engagement surface between a roller provided on the pull-off lever and the retention lever, so that when the pressuring force acts in the cutoff operation direction of the retention lever, the pull-off lever may be released without a cutoff command.

Further, although not described in Japanese Patent No. 3497866, it is just conceivable that the retention lever operates in the cutoff direction due to an impact force applied when the roller pushes aside the retention lever for reengagement in the closing operation to allow the cutoff operation to be started without a cutoff command. As described above, in the second example, it is difficult to significantly reduce the contact opening time period and it is likely that a retention state of the cutoff spring becomes unstable.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION

Figure 1:
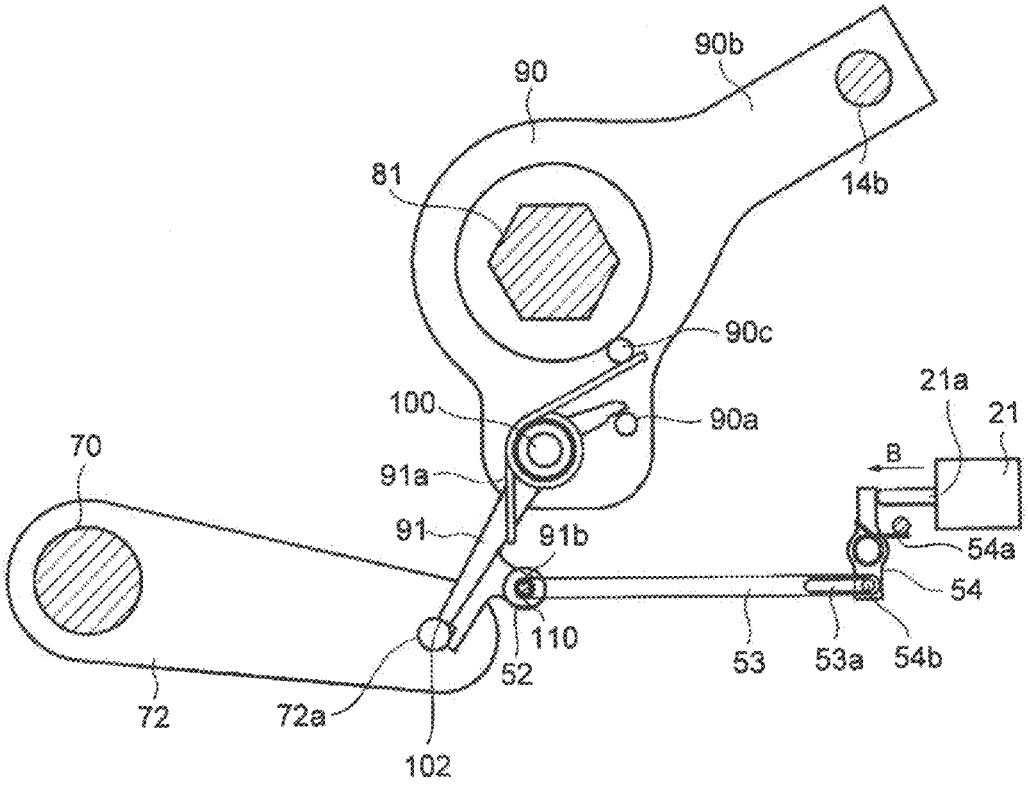
FIG. 1 is a front view illustrating a closed state of a retention unit and a retention control unit of a switchgear operating mechanism according to a first embodiment of the present invention.

The embodiments described here have been made to solve the above problems, and an object thereof is to provide a switchgear for opening/closing an electrical circuit and its operating mechanism in which retention/release of the cutoff spring force is performed by a combination of a latch and its lock mechanism to reduce a time period for the cutoff spring force to be released so as to significantly reduce the entire contact opening time period and, at the same time period, stability and reliability of a retention state of the cutoff spring force are improved.

In order to achieve the object, according to an aspect of the present invention, there is provided a switchgear operating mechanism for reciprocatively driving a movable contact of a switchgear so as to shift the switchgear between a cutoff state and a closed state, the operating mechanism comprising: a frame; a closing shaft rotatably disposed relative to the frame; a main lever which is fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably disposed and fixed to the sub-shaft; a main-sub connection link which rotatably connects a leading end of the sub-lever and the main lever; a cam mechanism which swings the sub-shaft in accordance with a rotation of the closing shaft; a latch lever which is swingably disposed and fixed to the sub-shaft; a roller pin rotatably attached to a leading end of the latch lever; a latch which is disposed so as to be rotated relative to the frame around a rotation axis substantially parallel to the rotation axis of the closing shaft; a latch return spring which biases the latch so as to rotate the latch in a predetermined direction; a latch pin which is fixed to the latch; and a ring which has an inner diameter larger than an outer diameter of the latch pin and is disposed surrounding an outer periphery of the latch pin in a radial direction so as to be movable in a radial direction of the latch pin. In the closed state, the roller pin pushes a leading end of the latch in a direction toward center of rotation axis of the latch. In a state where the switchgear operating state is shifted from the closed state to the cutoff state, the latch is pulled so as to allow the latch to be rotated in a direction opposite to the biasing direction of the latch return spring to release an engagement between the roller pin and the leading end of the latch, which causes the cutoff spring to discharge its energy to rotate the latch lever.

According to another aspect of the present invention, there is provided a switchgear operating mechanism for reciprocatively driving a movable contact of a switchgear so as to shift the switchgear between a cutoff state and a closed state, the operating mechanism comprising: a frame; a closing shaft rotatably disposed relative to the frame; a main lever which is fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably disposed and fixed to the sub-shaft; a main-sub connection link which rotatably connects a leading end of the sub-lever and the main lever; a cam mechanism which swings the sub-shaft in accordance with a rotation of the closing shaft; a latch lever which is swingably disposed and fixed to the sub-shaft; a roller pin rotatably attached to a leading end of the latch lever; a latch which is disposed so as to be rotated relative to the frame around a rotation axis substantially parallel to the rotation axis of the closing shaft; a latch return spring which biases the latch so as to rotate the latch in a predetermined direction; a latch pin which is fixed to the latch; a ring which has an inner diameter larger than an outer diameter of the latch pin and is disposed surrounding the outer periphery of the latch pin in a radial direction so as to be movable in a radial direction of the latch pin; a pull-off link mechanism which is engaged with the latch; a pull-off return spring for biasing the pull-off link mechanism in a predetermined direction; and an electromagnetic solenoid for cutoff which drives the pull-off link mechanism against a biasing force of the pull-off return spring to pull the latch so as to shift the switchgear operating state from the closed state to the cutoff state. In the closed state, the roller pin pushes the leading end of the latch in a direction toward a center of a rotation axis of the latch. In a state where the switchgear operating state is shifted from the closed state to the cutoff state, the latch is pulled so as to allow the latch to be rotated in a direction opposite to the biasing direction of the latch return spring to release an engagement between the roller pin and the leading end of the latch, which causes the cutoff spring to discharge its energy to rotate the latch lever. The pull-off link mechanism has: a pull-off link having a connection pin hole connected to a connection pin different from the latch pin disposed on the latch so as to be rotated relative to the connection pin, and a pull-off lever including a pull-off lever pin which is engaged with an elongated hole formed at one end of the pull-off link opposite to the end at which the latch pin hole is formed. When the electromagnetic solenoid for cutoff pushes the pull-off lever, the pull-off lever is rotated in a direction opposite to a biasing direction of the latch return spring. The latch has a pull-off link connection pin to which the pull-off link is connected.

According to another aspect of the present invention, there is provided a switchgear operating mechanism for reciprocatively driving a movable contact of a switchgear so as to shift the switchgear between a cutoff state and a closed state, the operating mechanism comprising: a frame; a closing shaft rotatably disposed relative to the frame; a main lever which is fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably disposed and fixed to the sub-shaft; a main-sub connection link which rotatably connects a leading end of the sub-lever and the main lever; a cam mechanism which swings the sub-shaft in accordance with a rotation of the closing shaft; a latch lever which is swingably disposed and fixed to the sub-shaft; a roller pin rotatably attached to a leading end of the latch lever; a latch which is disposed so as to be rotated relative to the frame around a rotation axis substantially parallel to the rotation axis of the closing shaft; a latch return spring which biases the latch so as to rotate the latch in a predetermined direction; a latch pin which is fixed to the latch; a pull-off link mechanism which is engaged with the latch; a pull-off return spring for biasing the pull-off link mechanism in a predetermined direction; and an electromagnetic solenoid for cutoff which drives the pull-off link mechanism against the biasing force of the pull-off return spring to pull the latch so as to shift the switchgear operating state from the closed state to the cutoff state. In the closed state, the roller pin pushes the leading end of the latch in a direction toward a center of a rotation axis of the latch. In a state where the switchgear operating state is shifted from the closed state to the cutoff state, the latch is pulled so as to allow the latch to be rotated in a direction opposite to the biasing direction of the latch return spring to release an engagement between the roller pin and a leading end of the latch, which causes the cutoff spring to discharge its energy to rotate the latch lever. The pull-off link mechanism has: a pull-off link having a latch pin hole formed surrounding the latch pin and having a size much larger than the level at which the latch pin hole can be rotated relative to the latch pin, and a pull-off lever including a pull-off lever pin which is engaged with an elongated hole formed at one end of the pull-off link opposite to the end at which the latch pin hole is formed. When the electromagnetic solenoid for cutoff pushes the pull-off lever, the pull-off lever is rotated in a direction opposite to the biasing direction of the latch return spring.

According to another aspect of the present invention, there is provided a switchgear having a movable contact that can be moved in a reciprocating manner and an operating mechanism that reciprocatively drives the movable contact and configured to be shifted between a cutoff state and a closed state by the movement of the movable contact, the operating mechanism comprising: a frame; a closing shaft rotatably disposed relative to the frame; a main lever which is fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably disposed and fixed to the sub-shaft; a main-sub connection link which rotatably connects a leading end of the sub-lever and the main lever; a cam mechanism which swings the sub-shaft in accordance with a rotation of the closing shaft; a latch lever which is swingably disposed and fixed to the sub-shaft; a roller pin rotatably attached to a leading end of the latch lever; a latch which is disposed so as to be rotated relative to the frame around a rotation axis substantially parallel to the rotation axis of the closing shaft; a latch return spring which biases the latch so as to rotate the latch in a predetermined direction; a latch pin which is fixed to the latch; and a ring which has an inner diameter larger than an outer diameter of the latch pin and is disposed surrounding the outer periphery of the latch pin in a radial direction so as to be movable in a radial direction of the latch pin. In the closed state, the roller pin pushes a leading end of the latch in a direction toward a center of a rotation axis of the latch. In a state where the switchgear operating state is shifted from the closed state to the cutoff state, the latch is pulled so as to allow the latch to be rotated in a direction opposite to the biasing direction of the latch return spring to release an engagement between the roller pin and the leading end of the latch, which causes the cutoff spring to discharge its energy to rotate the latch lever.

Embodiments of an operating mechanism of a switchgear according to the present invention will be described below with reference to the accompanying drawings.

First Embodiment

Figure 2:
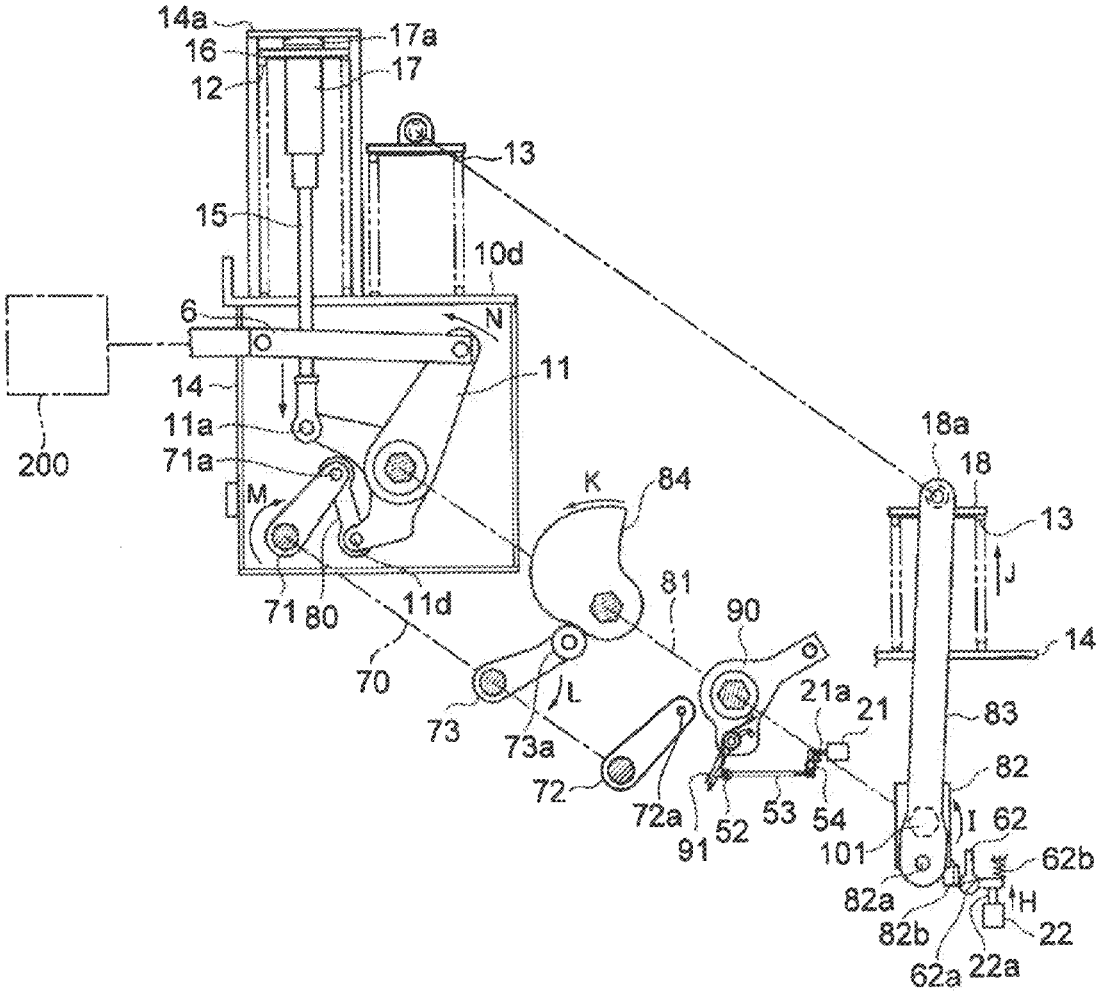
FIG. 2 is a developed front view illustrating a cutoff state of the spring operating mechanism of the switchgear illustrated in FIG. 1.
Figure 3:
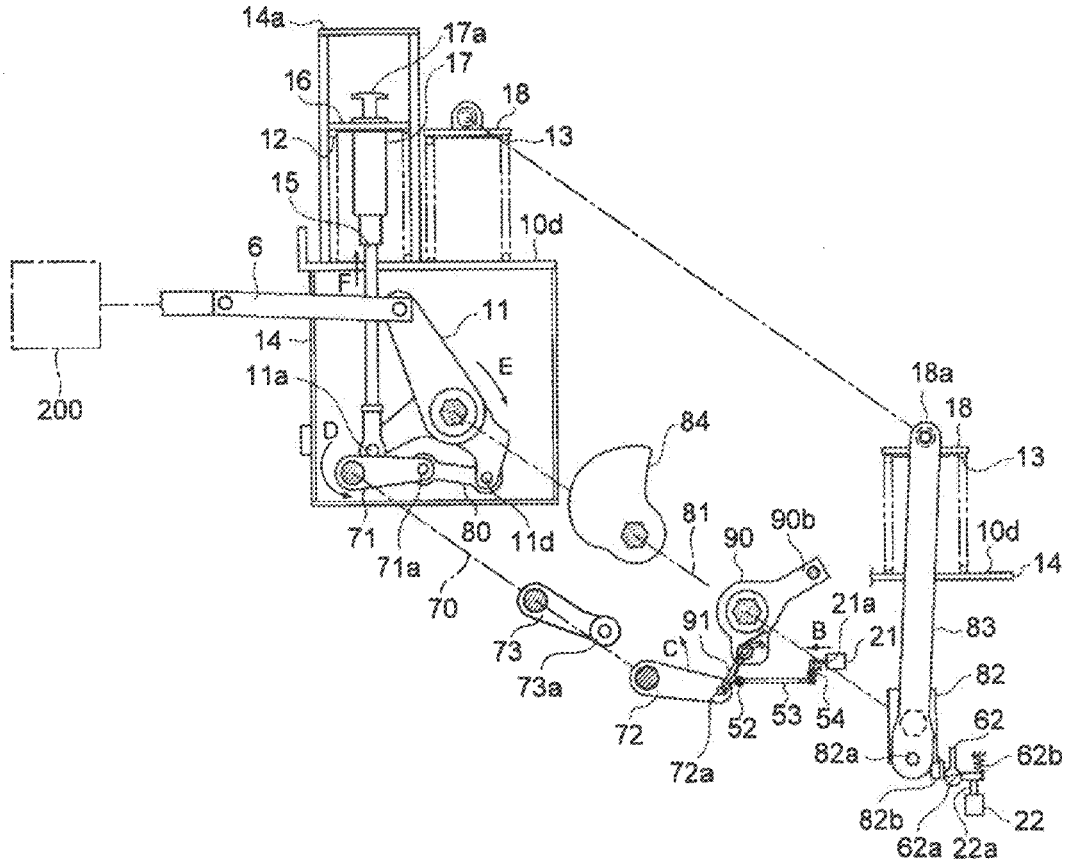
FIG. 3 is a developed front view illustrating a closed state of the spring operating mechanism of the switchgear illustrated in FIG. 1.
Figure 4:
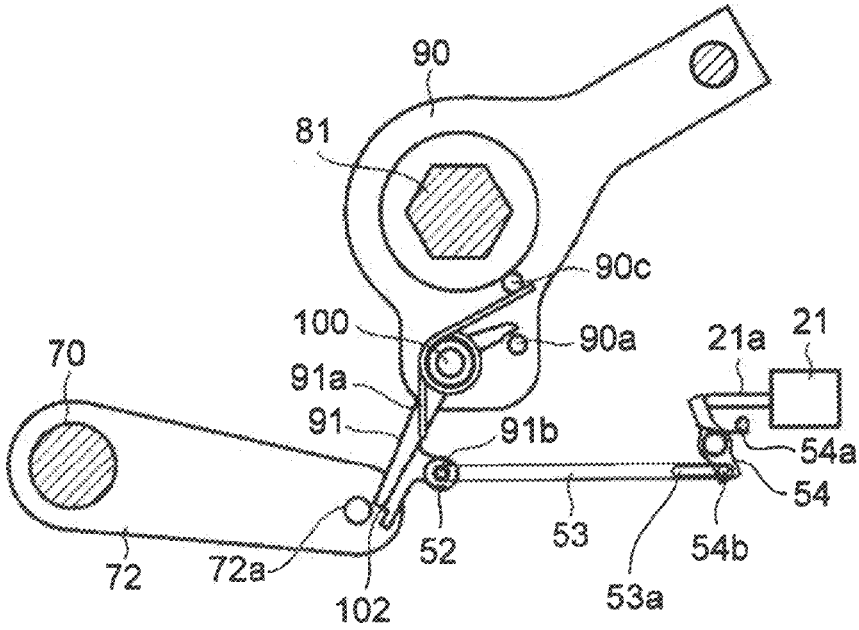
FIG. 4 is a front view of the main part of the switchgear of FIG. 1, which illustrates a cutoff operation process from the closed state to the cutoff state.
Figure 5:
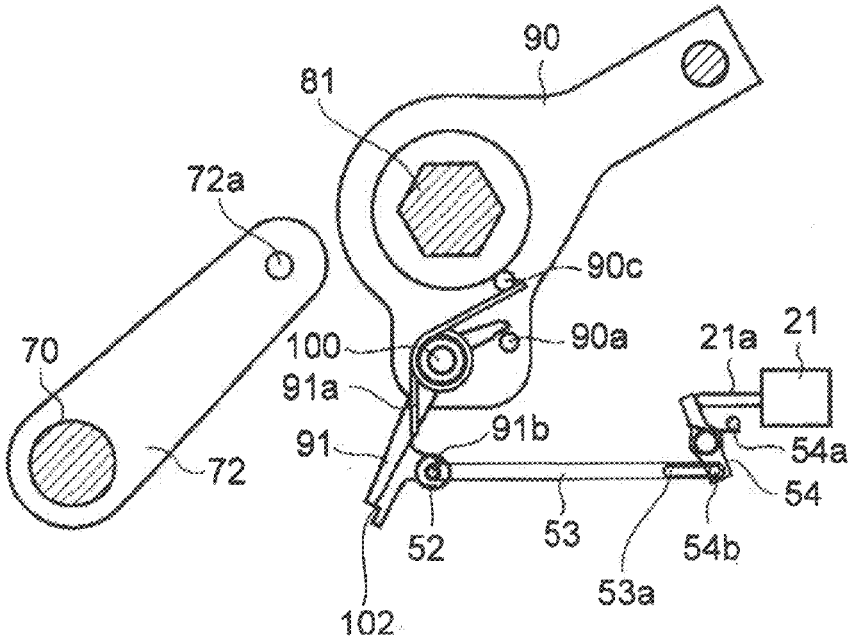
FIG. 5 is a front view of the main part of the switchgear of FIG. 1, which illustrates a cutoff operation process continued from FIG. 4.

First, with reference to FIGS. 1 to 10, a first embodiment of a switchgear operating mechanism according to the present invention will be described. FIG. 1 is a front view illustrating a closed state of a retention unit and a retention control unit of a switchgear operating mechanism. FIG. 2 is a view illustrating a cutoff state of a spring operating mechanism including the units illustrated in FIG. 1. FIG. 3 is a view illustrating a closed state of a spring operating mechanism including the units illustrated in FIG. 1. FIGS. 4 and 5 are views illustrating a cutoff operation process from the closed state to the cutoff state. FIGS. 6 to 10 are views illustrating a closing operation process from the cutoff state to the closed state.

In FIGS. 2 and 3, a movable contact 200 is connected to the left side of a link mechanism 6. When the link mechanism 6 is moved in the right direction as illustrated in FIG. 2, the movable contact 200 becomes "open" to achieve a cutoff state. On the other hand, when the link mechanism 6 is moved in the left direction as illustrated in FIG. 3, the movable contact 200 becomes "closed" to achieve a closed state. One end of the link mechanism 6 is rotatably engaged with the leading end of a main lever 11, and the main lever 11 is rotatably disposed and fixed to a closing shaft 81. The closing shaft 81 is rotatably supported by a bearing (not illustrated) fixed to a frame (support structure) 14.

A cutoff spring 12 has one end fixed to an attachment surface 10*d* of the frame 14 and the other end fitted to a cutoff spring receiver 16. A damper 17 is fixed to the cutoff spring receiver 16. In the damper 17, a fluid is encapsulated and a piston 17*a* is disposed so as to translationally slide. One end of the damper 17 is fixed to a cutoff spring link 15, which is rotatably attached to a pin 11*a* of the main lever 11.

A sub-shaft 70 is rotatably disposed relative to the frame 14, and a sub-lever 71 is fixed to the sub-shaft 70. A pin 71*a* is disposed at the leading end of the sub-lever 71. A pin 11*d* disposed in the main lever 11 and the pin 71*a* are connected by a main-sub connection link 80. A latch lever 72 is fixed to the sub-shaft 70, and a roller pin 72*a* is rotatably fitted to the leading end of the latch lever 72. Further, a cam lever 73 is fixed to the sub-shaft 70, and a roller 73*a* is rotatably fitted to the leading end of the cam lever 73.

A closing spring 13 has one end fixed to the attachment surface 10*d* of the frame 14 and the other end fixed to a closing spring receiver 18. A pin 18*a* is disposed in the closing spring receiver 18. The pin 18*a* is connected to a pin 82*a* of a closing lever 82 which is fixed to the end portion of the closing shaft 81 through a closing link 83. A closing cam 84 is fixed to the closing shaft 81 and releasably engaged with the roller 73*a* in accordance with the rotation of the closing shaft 81.

A tab 82*b* is disposed at one end of the closing lever 82 and is releasably engaged with a half-column portion 62*a* disposed in an anchoring lever 62 for closing which is rotatably disposed relative to the frame 14. Further, a return spring 62*b* is disposed at one end of the anchoring lever 62 for closing. The other end of the return spring 62*b* is fixed to the frame 14. The return spring 62*b* is a compression spring and the spring force thereof always acts on the anchoring lever 62 for closing as a clockwise torque. However, the rotation of the anchoring lever 62 is restricted by an engagement between a plunger 22*a* of an electromagnetic solenoid 22 for closing which is fixed to the frame 14 and the anchoring lever 62 for closing.

In the cutoff state illustrated in FIG. 2, a center 101 of the closing shaft 81 is displaced to the left relative to the center axis (or the axis connecting the centers of the pin 18*a* and the pin 82*a*) of the closing link 83, so that a counterclockwise torque is applied to the closing lever 82 by the closing spring 13. However, the rotation of the closing lever 82 is retained by an engagement between the tab 82*b* and the half-column portion 62*a*.

A protruding support portion 90*b* is formed at the leading end of an anchoring lever 90. The support portion 90*b* is engaged with a pin 14*b* which is fixed to the frame 14, which fixes the position of the anchoring lever 90 relative to the frame 14.

A latch 91 is rotatably disposed around a latch shaft pin 100 which is fixed to the end portion of the anchoring lever 90. A latch return spring 91*a* is disposed between the anchoring lever 90 and the latch 91. The end portion of the latch return spring 91*a* is engaged with a pin 90*c* fixed to the anchoring lever 90 and thereby the latch return spring 91*a* always generates a clockwise torque for the latch 91. The clockwise rotation of the latch 91 is restricted by an abutment between a stopper pin (stopper) 90*a* disposed on the anchoring lever 90 and the latch 91. A leading end 102 of the latch 91 is formed by a flat surface. A latch pin 91*b* is disposed on the latch 91, and a ring 52 is disposed on the latch pin 91*b* so as to be movable in the radial direction of the latch pin 91*b*. The inner diameter of the ring 52 is larger than the outer diameter of the latch pin 91*b*.

In the closed state illustrated in FIGS. 1 and 3, the leading end 102 is engaged with the roller pin 72*a*. In this state, the roller pin 72*a* pushes the leading end 102 in the direction toward the center of the rotation axis of the latch 91, thereby restricting the counterclockwise rotation of the latch 91.

A pull-off link mechanism has a pull-off link 53 and a pull-off lever 54 rotatably and translationally engaged with one end of the pull-off link 53. The pull-off link 53 has an elongated hole 53*a* at the engagement portion with a pull-off lever pin 54*b* disposed on the pull-off lever 54. The pull-off lever pin 54*b* and elongated hole 53*a* can be moved and rotated relative to each other within the range of the elongated hole 53*a*. The latch pin 91*b* is rotatably engaged with the end portion of the pull-off link 53 at the opposite side to the elongated hole 53*a*. The pull-off lever 54 is rotatably disposed relative to the frame 14 and always receives a clockwise torque by a pull-off return spring 54*a*.

A latch pin hole 110 engaged with the latch pin 91*b* is formed in the end portion of the pull-off link 53 at the opposite side to the elongated hole 53*a*. In the present embodiment, the inner diameter of the latch pin hole 110 is slightly larger than the outer diameter of the latch pin 91*b*.

The leading end of a plunger 21*a* of an electromagnetic solenoid 21 for cutoff which is fixed to the frame 14 is releasably engaged with the pull-off lever 54, which causes the pull-off lever 54 to be rotated in the counterclockwise direction upon input of an cutoff command.

In the closed state, the main lever 11 always receives a clockwise torque by a expanding spring force of the cutoff spring 12. The force transmitted to the main lever 11 is then transmitted to the sub-lever 71 through the main-sub connection link 80. The transmitted force becomes a torque for always rotating the sub-lever 71 in the counterclockwise direction. This counterclockwise torque is supplied also to the latch lever 72. However, in the closed state, the leading end 102 of the latch 91 and the roller pin 72*a* are engaged with each other to restrict the counterclockwise rotation of the latch lever 72. Accordingly, the subsequent members from the sub-lever 71 to the cutoff spring 12 maintain their static state.

In the present embodiment, the rotation shafts, such as the closing shaft 81 and sub-shaft 70, and axes of the various pins are parallel to each other.

(Cutoff Operation)

In the present embodiment having the configuration described above, a cutoff operation from the closed state illustrated in FIGS. 1 and 3, through states illustrated in FIGS. 4 and 5, to the cutoff state illustrated in FIG. 2 will be described. First, in the closed state illustrated in FIGS. 1 and 3, upon input of an external command, the electromagnetic solenoid 21 for cutoff is excited to move the plunger 21*a* in the direction of an arrow B. Since the pull-off lever 54 is engaged with the plunger 21*a*, it is rotated in the counterclockwise direction. In conjunction with the rotation, the pull-off link 53 is moved to the right while being engaged with the latch pin 91*b* to rotate the latch 91 in the clockwise direction. With this operation, the engagement between the leading end 102 of the latch 91 and roller pin 72*a* is released.

This state is illustrated in FIG. 4.

The latch lever 72 receives a counterclockwise torque from the cutoff spring 12, so that it is rotated in the counterclockwise direction while pushing the latch 91. At this time, the pull-off link 53 moves with the elongated hole 53*a* and the pull-off lever pin 54*b* engaged with each other, so that the pull-off link 53 operates independently of the pull-of lever 54. This state is illustrated in FIG. 5.

FIG. 2 illustrates the end state of the cutoff operation. In this state, the latch 91 has been returned to substantially the same position as that in the closed state (FIGS. 1 and 3) by the latch return spring 91*a* (FIG. 1). Further, the pull-off link 53 and pull-off lever 54 have been returned to substantially the same position as those in the closed state (FIGS. 1 and 3) by the pull-off return spring 54*a* (FIG. 1).

When an engagement between the latch 91 and the roller pin 72*a* is released in FIG. 3, the cam lever 73 and sub-lever 71, which are fixed to the latch lever 72 and the sub-shaft 70, are rotated in the counterclockwise direction (denoted by arrows C and D). Then, the main lever 11 is rotated in the clockwise direction (denoted by an arrow E) to cause the cutoff spring 12 and damper 17 to be moved in the direction of an arrow F. Then, the link mechanism 6 and the movable contact 200 connected to the link mechanism 6 are moved to the right to start the cutoff operation.

When the cutoff spring 12 is displaced by a given distance, the piston 17*a* abuts with the stopper 14*a* fixed to the frame 14 to generate a braking power of the damper 17 to thereby stop the movement of the cutoff spring 12. The movements of the link levers connected to the cutoff spring 12 are accordingly stopped, thereby completing the cutoff operation. This state is illustrated in FIG. 2.

(Closing Operation)

Next, a closing operation from the cutoff state illustrated in FIG. 2, through states illustrated in FIGS. 6 to 10, to the closed state illustrated in FIGS. 1 and 3 will be described.

FIG. 2 illustrates a state where the closing spring 13 accumulates energy in the cutoff state. Upon input of an external command, the electromagnetic solenoid 22 for closing is excited to move the plunger 22*a* in the direction of an arrow H. The anchoring lever 62 for closing is engaged with the plunger 22*a*, so that it is rotated in the counterclockwise direction. Then, the engagement between the half-column portion 62*a* and the tab 82*b* is released. Accordingly, the closing lever 82 and the closing shaft 81 are rotated in the counterclockwise direction (denoted by an arrow I) by a spring force of the closing spring 13. The closing spring 13 is stretched in the direction of an arrow J and discharges its accumulated energy. The closing cam 84 fixed to the closing shaft 81 is rotated in the direction of an arrow K to be engaged with the roller 73*a*. When the roller 73*a* is pushed by the closing cam 84, the cam lever 73 is rotated in the clockwise direction (denoted by an arrow L) and, at the same time, the sub-lever 71 is rotated in the direction of an arrow M.

When the rotation of the sub-lever 71 is transmitted to the main lever 11, the main lever 11 is rotated in the counterclockwise direction (denoted by an arrow N). Then, the link mechanism 6 and movable contact 200 connected to the link mechanism 6 are moved to the left to start the closing operation. The cutoff spring 12 is compressed in association with the rotation of the main lever 11 to accumulate energy to establish an engagement between the roller pin 72*a* and the latch 91 once again, thereby completing the closing operation.

Figure 6:
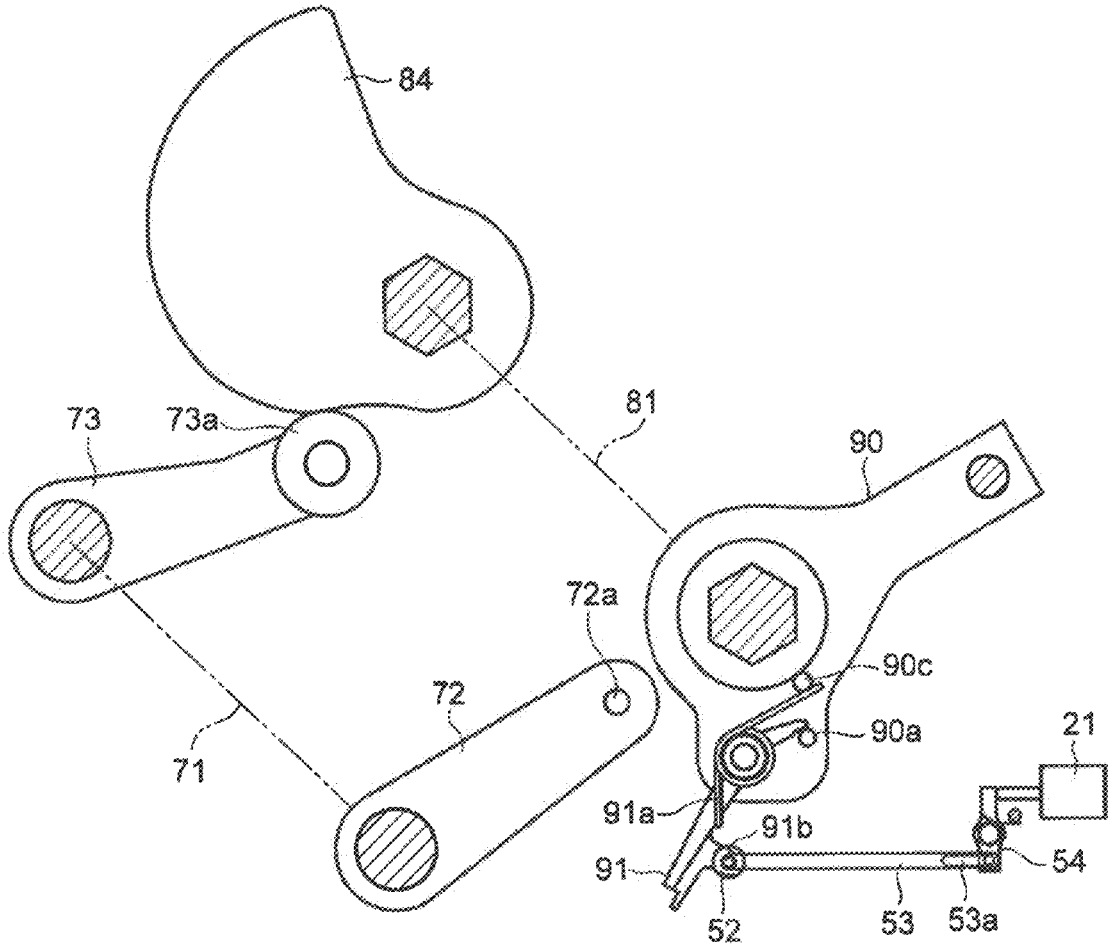
FIG. 6 is a front view of the main part of the switchgear of FIG. 1, which illustrates a closing operation process from the cutoff state to the closed state.

The latch lever 72 is rotated in the clockwise direction, as well as the latch lever 72 fixed to the cam lever 73 and sub-shaft 70 is rotated in the clockwise direction in a state where the operation is shifted from the cutoff state illustrated in FIG. 2 to the closing operation. This state is illustrated in FIG. 6.

Subsequently, after the state illustrated in FIG. 6, the latch 91 is rotated in the counterclockwise direction by the roller pin 72*a*. This state is illustrated in FIG. 7.

Figure 7:
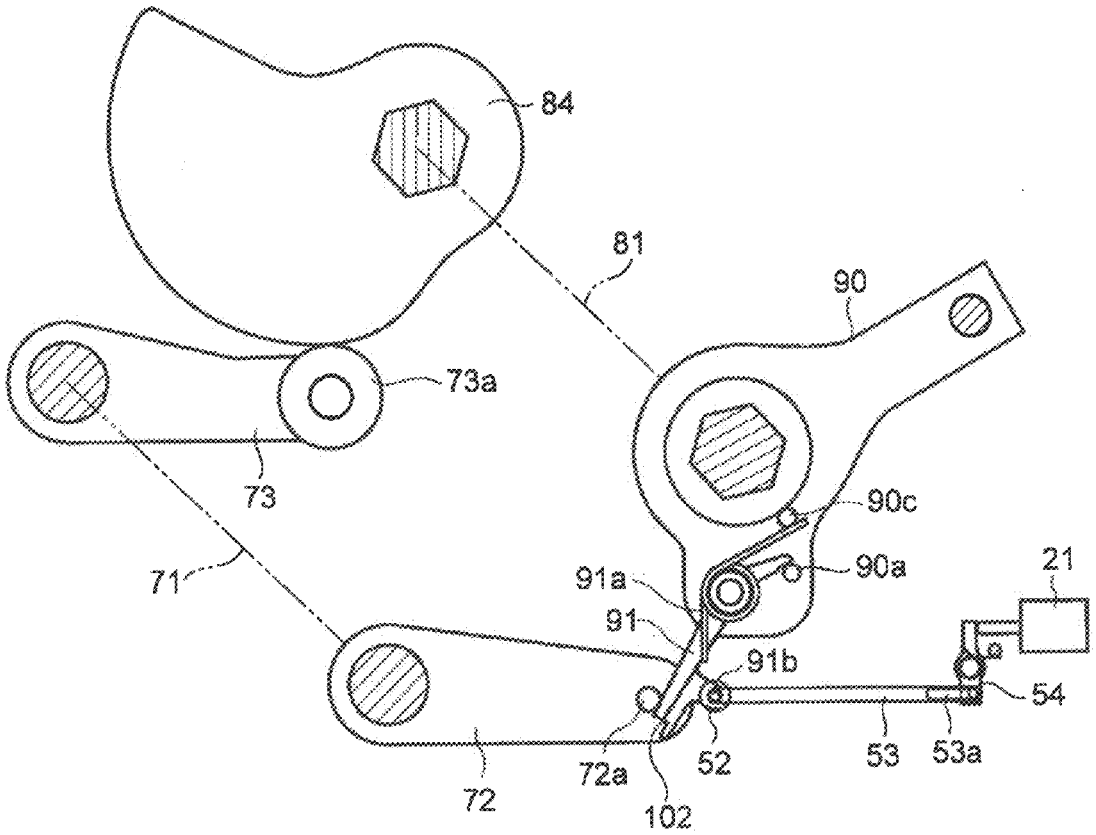
FIG. 7 is a front view of the main part of the switchgear of FIG. 1, which illustrates a closing operation process continued from FIG. 6.
Figure 8:
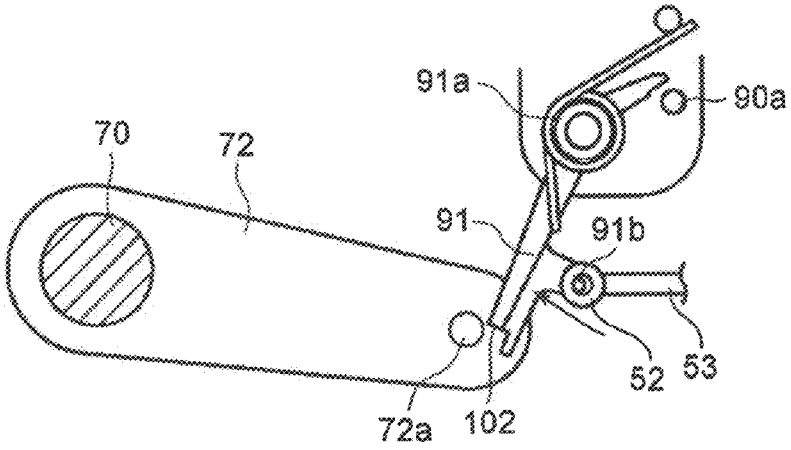
FIG. 8 is a front view of the main part of the switchgear of FIG. 1, which illustrates a closing operation process continued from FIG. 7 before completion of the closing operation process.
Figure 9:
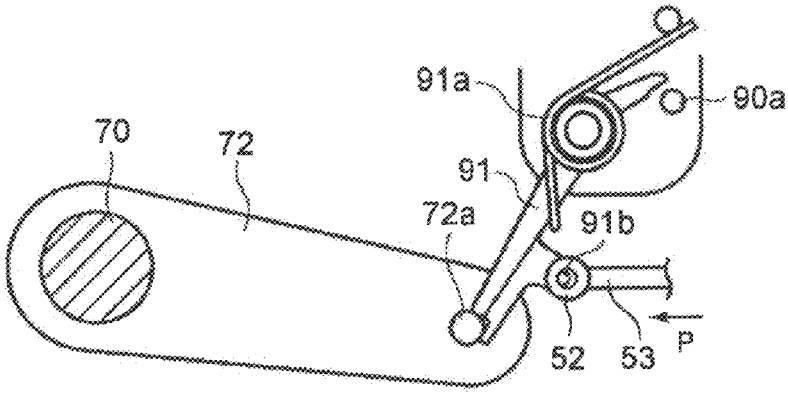
FIG. 9 is a front view of the main part of the switchgear of FIG. 1, which illustrates a closing operation process continued from FIG. 8 before completion of the closing operation process.
Figure 10:
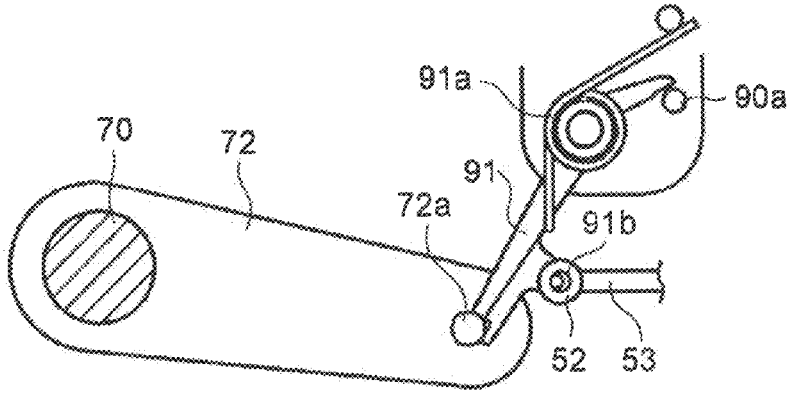
FIG. 10 is a front view of the main part of the switchgear of FIG. 1, which illustrates a closing operation process continued from FIG. 9 immediately before completion of the closing operation process.

States immediately before the completion of the closing operation are shown in FIGS. 8 to 10, following the state shown in FIG. 7. When an engagement between the closing cam 84 and the roller 73*a* is released, the roller pin 72*a* is moved to the closed-state position by the expanding force of the cutoff spring 12. Further, when an engagement between the roller pin 72*a* and the latch 91 is released, the latch 91 is returned to the closed-state position by the latch return spring 91*a*, and the leading end 102 of the latch 91 and the roller pin 72*a* are re-engaged with each other (FIGS. 8 and 9). At this re-engagement operation, a force acting from the roller pin 72*a* to the latch 91 is directed to substantially the rotation center of the latch 91.

However, at the time when the latch 91 is returned to the closed-state position by the latch return spring 91*a*, the latch 91 collides with the roller pin 72*a* and bounces, so that the latch 91 is rotated in the counterclockwise direction. This can cause release of the engagement between the leading end 102 of the latch 91 and roller pin 72*a*, resulting in malfunction. However, in the present embodiment, when the latch 91 collides with the roller pin 72*a*, the ring 52 is moved by an inertia force in the direction of an arrow P (FIG. 9) which is opposite to the direction in which the latch 91 bounces and collides with the latch pin 91*b* (FIG. 10). This prevents the latch 91 from being rotated in the counterclockwise rotation, thereby preventing malfunction of the latch 91.

FIGS. 1 and 3 illustrate a state where the closing operation has been completed.

According to the present embodiment, after the electromagnetic solenoid 21 for cutoff is excited upon input of a cutoff command, the cutoff operation is completed by two operation steps: a first operation step in which the latch 91 is directly driven through the pull-off lever 54 and the pull-off link 53 to release an engagement between the latch 91 and the roller pin 72*a*; and a second operation step in which the cutoff spring 12 operates. As described above, the number of operation steps for completing the cutoff operation is reduced from three (in the case of conventional spring operating mechanism) to two, thereby significantly reducing the cutoff operation time period. This means that T2 is removed from the expression (1) representing the contact opening time period, so that it is possible to reduce the contact opening time period.

Further, a separation of the latch 91 due to collision between the latch 91 and the roller pin 72*a* during the closing operation can be prevented by means of the ring 52, enabling an increase in reliability of the operation of the spring operating mechanism.

Further, the engagement surface of the leading end 102 of the latch 91 is formed by a flat surface, and the roller pin 72*a* pushes the leading end 102 in the direction toward the center of the rotation axis (i.e., center of the latch axis pin 100) of the latch 91 at the closing operation time period, so that a torque is not transmitted from the roller pin 72*a* to latch 91. This allows a reduction of the size to thereby minimize a force required for releasing its engagement, which can minimize the size of the electromagnetic solenoid.

Further, by designing the ring 52 to be formed of metal having high hardness and high density, a high-polymer material having high elasticity, or a complex thereof, it is possible to enhance the effect of preventing a separation of the latch 91.

Further, by setting the mass of the ring 52 to a value not more than an equivalent mass of the latch 91 obtained by dividing the moment of inertia around the center of the latch axis pin 100 of the latch 91 by the square of the distance between the center of the latch axis pin 100 and latch pin 91*b*, it is possible to increase the direct drive speed of the latch 91, enabling a reduction in the contact opening time period.

Further, by coating diamond-like carbon on the leading end 102 of the latch 91, the roller pin 72*a*, or both of them, the sliding property can be increased, enabling a reduction in the contact opening time period.

The diamond-like carbon may be coated not only on the leading end 102 of the latch 91, the roller pin 72*a*, or both of them, but also on other sliding surfaces, which enables a reduction in the contact opening time period and increase in the operation stability in the switchgear and its operating mechanism. For example, by coating the diamond-like carbon on the inner wall surface of the elongated hole 53*a* of the pull-off link 53, the pull-off lever pin 54*b*, or both of them, it is possible to achieve a reduction in the contact opening time period and increase in the stability of the cutoff operation.

Further, by coating the diamond-like carbon on the tab 82*b* of the closing lever 82, the half-column portion 62*a* disposed in the anchoring lever 62 for closing, or both of them, it is possible to prevent instability of the closing operation due to lack of lubricant oil.

Second Embodiment

Figure 11:
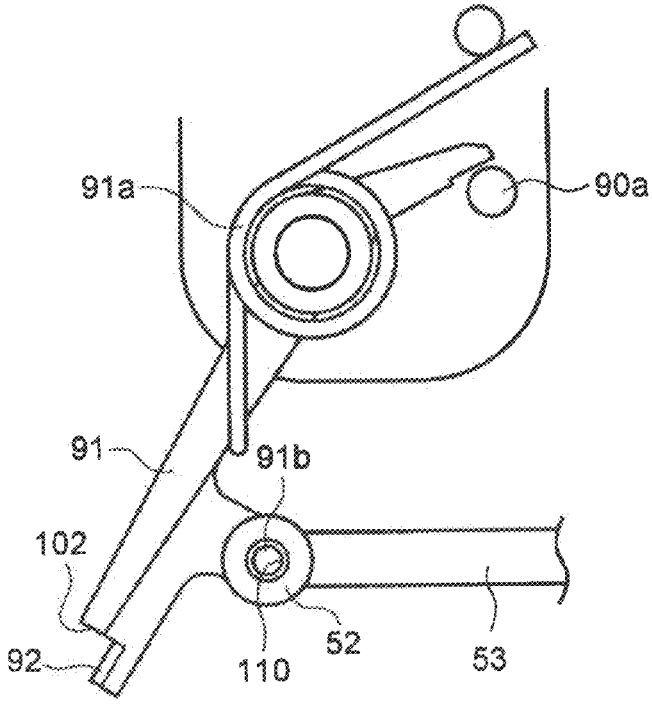
FIG. 11 is a front view illustrating the latch, main part of the pull-off link, and their surrounding portion in the operating mechanism of the switchgear according to a second embodiment of the present invention.

FIG. 11 is a front view illustrating the latch, main part of the pull-off link, and their surrounding portion in the operating mechanism of the switchgear according to a second embodiment of the present invention. In FIG. 11, the same reference numerals as those in the first embodiment denote the same or similar parts as those in the first embodiment, and overlapping description thereof will be omitted here. In the present embodiment, a vibration absorbing member 92 having high vibration absorption property, such as a high-polymer material, is disposed on the leading end of the latch 91. This alleviates the bounce of the latch 91 due to collision between the latch 91 and roller pin 72*a*, enhancing the effect of preventing a separation of the latch 91.

Third Embodiment

Figure 12:
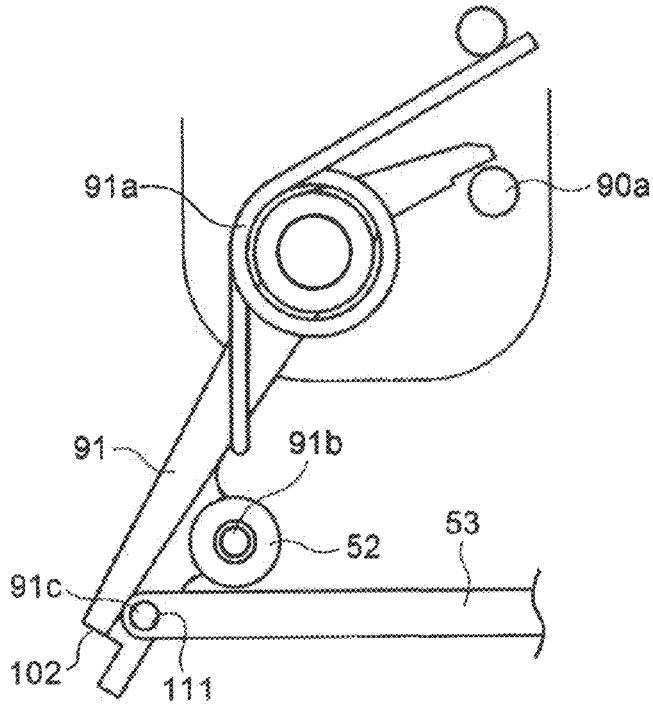
FIG. 12 is a front view illustrating the latch, main part of the pull-off link, and their surrounding portion in the operating mechanism of the switchgear according to a third embodiment of the present invention.

FIG. 12 is a front view illustrating the latch, main part of the pull-off link, and their surrounding portion in the operating mechanism of the switchgear according to a third embodiment of the present invention. In FIG. 12, the same reference numerals as those in the first embodiment denote the same or similar parts as those in the first embodiment, and overlapping description thereof will be omitted here. In the present embodiment, the latch pin 91*b* is disposed on the latch 91, and the ring 52 is disposed on the latch pin 91*b* so as to be movable in the radial direction of the latch pin 91*b*, as in the case of the first embodiment. Further, in the present embodiment, a connection pin 91*c* is disposed on the latch 91. Correspondingly, a connection pin hole 111 is formed in the pull-off link 53 so as to be engaged with the connection pin 91*c*. With this configuration, the same effect as in the first embodiment can be obtained.

Fourth Embodiment

Figure 13:
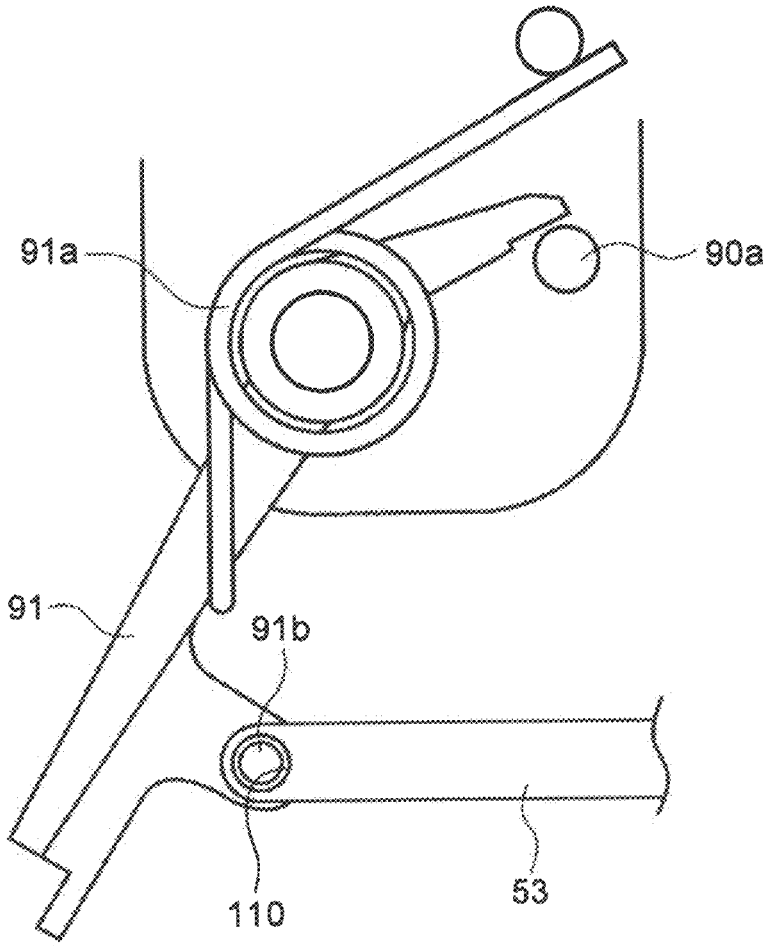
FIG. 13 is a front view illustrating the latch, main part of the pull-off link, and their surrounding portion in the operating mechanism of the switchgear according to a fourth embodiment of the present invention.
Figure 14:
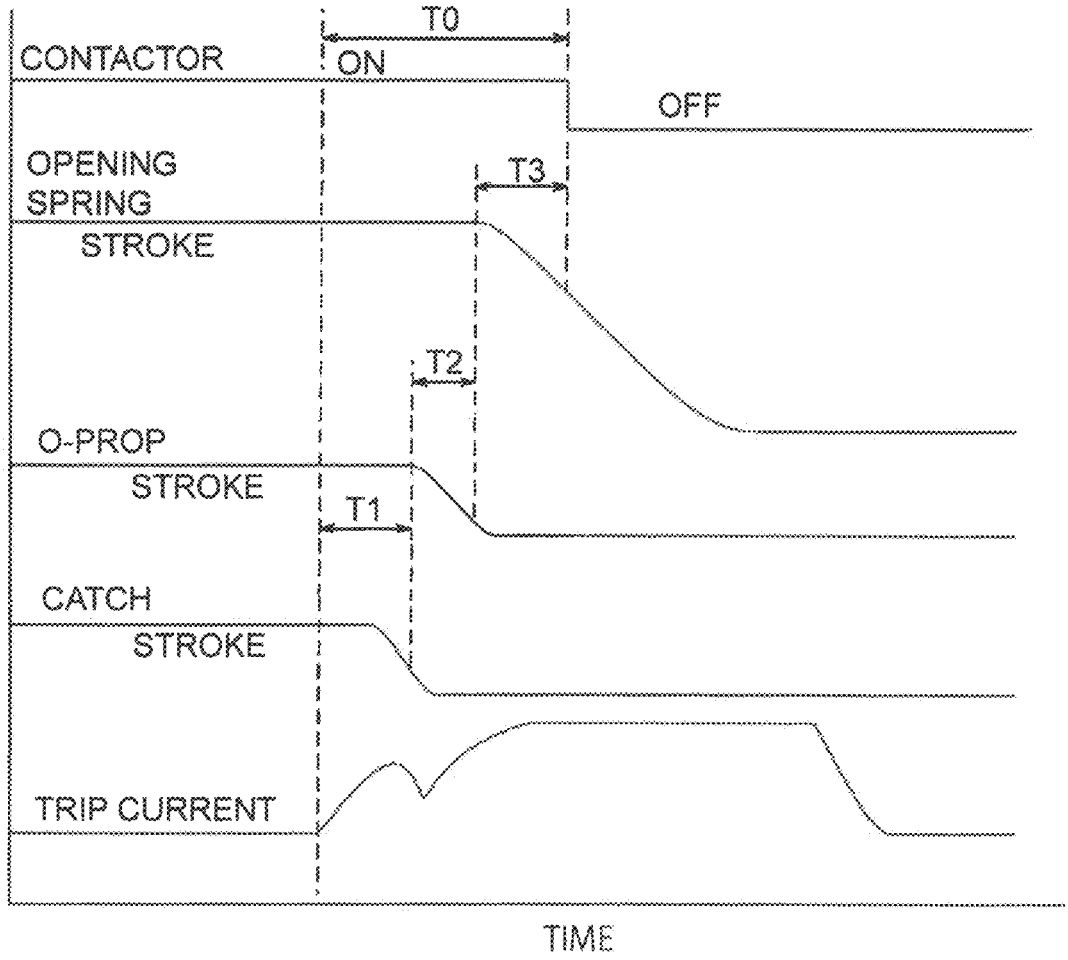
FIG.14 PRIOR ART
FIG. 14 is a time chart for explaining the cutoff operation of a conventional switchgear.

FIG. 13 is a front view illustrating the latch, main part of the pull-off link, and their surrounding portion in the operating mechanism of the switchgear according to a fourth embodiment of the present invention. In FIG. 13, the same reference numerals as those in the first embodiment denote the same or similar parts as those in the first embodiment, and overlapping description thereof will be omitted here. In the present embodiment, the ring 52 of the first embodiment is not used, but the latch pin hole to be connected to the latch pin 91*b* of the pull-off link 53 is designed to have a sufficient gap relative to the diameter of the latch pin 91*b*. With this configuration, the pull-off link 53 produces the same effect as that produced by the ring 52.

The embodiments described above are merely given as examples, and it should be understood that the present invention is not limited thereto.

For example, it is possible to provide a plurality of the rings 52 of the first to third embodiments. In this case, by making the inner diameters and outer diameters of the respective rings 52 differ from one another, the rings 52 collide with the latch pin 91*b* with time lags, thereby enhancing the effect of preventing a separation of the latch 91. Further, by making the masses of the respective rings 52 differ from one another, the rings 52 collide with the latch pin 91*b* with time lags, thereby enhancing the effect of preventing a separation of the latch 91. In this case, by setting the total mass of the rings 52 to a value not more than an equivalent mass of the latch 91 obtained by dividing the moment of inertia around the center of the latch axis pin 100 of the latch 91 by the square of the distance between the center of the latch axis pin 100 and the latch pin 91*b*, it is possible to increase the direct drive speed of the latch 91, enabling a reduction in the contact opening time period.

Although the ring 52 of the first to third embodiments has a hollow doughnut-like shape, the shape of the ring 52 is not limited to that shape, but the same effect can be obtained even with a shape other than the hollow doughnut-like shape.

Although compression coil springs are used as the cutoff spring 12 and the closing spring 13 in the above embodiments, other elastic bodies, such as torsion coil springs, disc springs, spiral springs, plate springs, air springs, and tension springs may be used alternatively. Further, although coil springs or torsion coil springs are used as the return springs 62*b*, 54*a*, and 91*a* disposed on the anchoring lever 62 for closing, the pull-off lever 54, and latch 91, other elastic bodies such as disc springs, spiral springs, or plate springs may be used alternatively.

The present invention can also be applied to an apparatus having a plurality of cutoff springs or plurality of the closing springs.

Although the stopper pin 90*a* and the pin 90*c* engaged with the end portion of the latch return spring 91*a* are separately disposed, the functions of the above two pins may be provided by one pin.

Further, since the anchoring lever 90 is fixed to the frame 14, it may be omitted. In this case, the stopper pins 90*a* and 90*c*, etc., may be directly fixed to the frame 14. Further, the stopper pins 90*a* and 90*c* may be integrated with the anchoring lever 90 or the frame 14.

Further, although the vibration absorbing member is attached to the latch of the first embodiment in the second embodiment, the vibration absorbing member may be alternatively attached to the latch of the third or fourth embodiment.

According to the embodiments described above, in a switchgear for opening/closing an electric circuit and its operating mechanism, retention and release of a cutoff spring force is performed by a combination of a latch and its lock mechanism. With this configuration, it is possible to reduce the time period required for releasing the cutoff spring force to thereby reduce the entire contact opening time period. At the same time, stability and reliability of a retention state of the cutoff spring force can be improved.

What is claimed is:

1. A switchgear operating mechanism for reciprocatively driving a movable contact of a switchgear so as to shift the switchgear between a cutoff state and a closed state, the operating mechanism comprising:

a frame;

a closing shaft rotatably disposed relative to the frame;

a main lever which is fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably disposed and fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably disposed and fixed to the sub-shaft;

a roller pin rotatably attached to a leading end of the latch lever;

a latch which is disposed so as to be rotated relative to the frame around a rotation axis substantially parallel to the rotation axis of the closing shaft;

a latch return spring which biases the latch so as to rotate the latch in a predetermined direction;

a latch pin which is fixed to the latch; and a ring which has an inner diameter larger than an outer diameter of the latch pin and is disposed surrounding an outer periphery of the latch pin in a radial direction so as to be movable in a radial direction of the latch pin, wherein in the closed state, the roller pin pushes a leading end of the latch in a direction toward center of rotation axis of the latch, and in a state where the switchgear operating state is shifted from the closed state to the cutoff state, the latch is pulled so as to allow the latch to be rotated in a direction opposite to the biasing direction of the latch return spring to release an engagement between the roller pin and the leading end of the latch, which causes the cutoff spring to discharge its energy to rotate the latch lever.

2. The switchgear operating mechanism according to claim 1, further comprising:

a pull-off link mechanism engaged with the latch;

a pull-off return spring for biasing the pull-off link mechanism in a predetermined direction; and an electromagnetic solenoid for cutoff which drives the pull-off link mechanism against a biasing force of the pull-off return spring to pull the latch so as to shift the switchgear operating state from the closed state to the cutoff state.

3. The switchgear operating mechanism according to claim 2, wherein the pull-off link mechanism has: a pull-off link having a latch pin hole connected to the latch pin disposed on the latch so as to be rotated relative to the latch pin, and a pull-off lever including a pull-off lever pin which is engaged with an elongated hole formed at one end of the pull-off link opposite to the end at which the latch pin hole is formed, and when the electromagnetic solenoid for cutoff pushes the pull-off lever, the pull-off lever is rotated in the direction opposite to the biasing direction of the latch return spring.

4. The switchgear operating mechanism according to claim 1, wherein a total mass of the ring is not more than an equivalent mass of the latch.

5. The switchgear operating mechanism according to claim 1, comprising:

a closing lever which is fixed to the closing shaft;

a closing link rotatably connected to the closing lever; and a closing spring which is disposed between a leading end of the closing link and the frame so as to bias the leading end of the closing link in a direction apart from the closing shaft.

6. The switchgear operating mechanism according to claim 5, wherein the closing spring is disposed such that it accumulates energy in the closing state or cutoff state in accordance with the rotation of the closing shaft while it discharges its accumulated energy when the switchgear operating state is shifted from the cutoff state to the closed state.

7. The switchgear operating mechanism according to claim 5, further comprising a tab disposed at a leading end of the closing lever and a retention unit engaged with the tab, the retention unit having; an anchoring lever for closing having a half-column portion; a return spring for biasing the anchoring lever for closing in a predetermined direction; and an electromagnetic solenoid for closing which drives the retention unit against the biasing force of the return spring to move the anchoring lever for closing so as to shift the switchgear operating state from the cutoff state to the closed state.

8. The switchgear operating mechanism according to claim 1, wherein diamond-like carbon is coated on at least one of the latch and the roller pin.

9. The switchgear operating mechanism according to claim 1, wherein a vibration absorbing member is disposed on the leading end of the latch.

10. A switchgear operating mechanism for reciprocatively driving a movable contact of a switchgear so as to shift the switchgear between a cutoff state and a closed state, the operating mechanism comprising:

a frame;

a closing shaft rotatably disposed relative to the frame;

a main lever which is fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably disposed and fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably disposed and fixed to the sub-shaft;

a roller pin rotatably attached to a leading end of the latch lever;

a latch which is disposed so as to be rotated relative to the frame around a rotation axis substantially parallel to the rotation axis of the closing shaft;

a latch return spring which biases the latch so as to rotate the latch in a predetermined direction;

a latch pin which is fixed to the latch;

a ring which has an inner diameter larger than an outer diameter of the latch pin and is disposed surrounding the outer periphery of the latch pin in a radial direction so as to be movable in a radial direction of the latch pin;

a pull-off link mechanism which is engaged with the latch;

a pull-off return spring for biasing the pull-off link mechanism in a predetermined direction; and an electromagnetic solenoid for cutoff which drives the pull-off link mechanism against a biasing force of the pull-off return spring to pull the latch so as to shift the switchgear operating state from the closed state to the cutoff state, wherein in the closed state, the roller pin pushes the leading end of the latch in a direction toward a center of a rotation axis of the latch, in a state where the switchgear operating state is shifted from the closed state to the cutoff state, the latch is pulled so as to allow the latch to be rotated in a direction opposite to the biasing direction of the latch return spring to release an engagement between the roller pin and the leading end of the latch, which causes the cutoff spring to discharge its energy to rotate the latch lever, the pull-off link mechanism has: a pull-off link having a connection pin hole connected to a connection pin different from the latch pin disposed on the latch so as to be rotated relative to the connection pin, and a pull-off lever including a pull-off lever pin which is engaged with an elongated hole formed at one end of the pull-off link opposite to the end at which the latch pin hole is formed, when the electromagnetic solenoid for cutoff pushes the pull-off lever, the pull-off lever is rotated in a direction opposite to a biasing direction of the latch return spring, and the latch has a pull-off link connection pin to which the pull-off link is connected.

11. The switchgear operating mechanism according to claim 10, wherein a total mass of the ring is not more than an equivalent mass of the latch.

12. The switchgear operating mechanism according to claim 10, comprising:

a closing lever which is fixed to the closing shaft;

a closing link rotatably connected to the closing lever; and a closing spring which is disposed between a leading end of the closing link and the frame so as to bias the leading end of the closing link in a direction apart from the closing shaft.

13. The switchgear operating mechanism according to claim 10, wherein diamond-like carbon is coated on at least one of the latch and the roller pin.

14. The switchgear operating mechanism according to claim 10, wherein a vibration absorbing member is disposed on the leading end of the latch.

15. A switchgear operating mechanism for reciprocatively driving a movable contact of a switchgear so as to shift the switchgear between a cutoff state and a closed state, the operating mechanism comprising:

a frame;

a closing shaft rotatably disposed relative to the frame;

a main lever which is fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably disposed and fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably disposed and fixed to the sub-shaft;

a roller pin rotatably attached to a leading end of the latch lever;

a latch which is disposed so as to be rotated relative to the frame around a rotation axis substantially parallel to the rotation axis of the closing shaft;

a latch return spring which biases the latch so as to rotate the latch in a predetermined direction;

a latch pin which is fixed to the latch;

a pull-off link mechanism which is engaged with the latch;

a pull-off return spring for biasing the pull-off link mechanism in a predetermined direction; and an electromagnetic solenoid for cutoff which drives the pull-off link mechanism against the biasing force of the pull-off return spring to pull the latch so as to shift the switchgear operating state from the closed state to the cutoff state, wherein in the closed state, the roller pin pushes the leading end of the latch in a direction toward a center of a rotation axis of the latch, in a state where the switchgear operating state is shifted from the closed state to the cutoff state, the latch is pulled so as to allow the latch to be rotated in a direction opposite to the biasing direction of the latch return spring to release an engagement between the roller pin and a leading end of the latch, which causes the cutoff spring to discharge its energy to rotate the latch lever, the pull-off link mechanism has: a pull-off link having a latch pin hole formed surrounding the latch pin and having a size much larger than the level at which the latch pin hole can be rotated relative to the latch pin, and a pull-off lever including a pull-off lever pin which is engaged with an elongated hole formed at one end of the pull-off link opposite to the end at which the latch pin hole is formed, and when the electromagnetic solenoid for cutoff pushes the pull-off lever, the pull-off lever is rotated in a direction opposite to the biasing direction of the latch return spring.

16. The switchgear operating mechanism according to claim 15, comprising:

a closing lever which is fixed to the closing shaft;

a closing link rotatably connected to the closing lever; and a closing spring which is disposed between a leading end of the closing link and the frame so as to bias the leading end of the closing link in a direction apart from the closing shaft.

17. The switchgear operating mechanism according to claim 15, wherein diamond-like carbon is coated on at least one of the latch and the roller pin.

18. The switchgear operating mechanism according to claim 15, wherein a vibration absorbing member is disposed on the leading end of the latch.

19. A switchgear having a movable contact that can be moved in a reciprocating manner and an operating mechanism that reciprocatively drives the movable contact and configured to be shifted between a cutoff state and a closed state by the movement of the movable contact, the operating mechanism comprising:

a frame;

a closing shaft rotatably disposed relative to the frame;

a main lever which is fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably disposed and fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably disposed and fixed to the sub-shaft;

a roller pin rotatably attached to a leading end of the latch lever;

a latch which is disposed so as to be rotated relative to the frame around a rotation axis substantially parallel to the rotation axis of the closing shaft;

a latch return spring which biases the latch so as to rotate the latch in a predetermined direction;

a latch pin which is fixed to the latch; and a ring which has an inner diameter larger than an outer diameter of the latch pin and is disposed surrounding the outer periphery of the latch pin in a radial direction so as to be movable in a radial direction of the latch pin, wherein in the closed state, the roller pin pushes a leading end of the latch in a direction toward a center of a rotation axis of the latch, and in a state where the switchgear operating state is shifted from the closed state to the cutoff state, the latch is pulled so as to allow the latch to be rotated in a direction opposite to the biasing direction of the latch return spring to release an engagement between the roller pin and the leading end of the latch, which causes the cutoff spring to discharge its energy to rotate the latch lever.

* * * * *